US005852424A

United States Patent [19]

Reineck et al.

[11] Patent Number: 5,852,424

[45] Date of Patent: Dec. 22, 1998

[54] BUILDING ELEMENTS AND SUPPORT STRUCTURE FOR ENCLOSING AN ANTENNA

[75] Inventors: Michael J. Reineck; Kenneth M. Wedholm, both of Charleston, S.C.

[73] Assignee: Stealth Network Technologies Inc., Charleston, S.C.

[21] Appl. No.: 859,026

[22] Filed: May 20, 1997

[51] Int. Cl.[6] ..... H01Q 1/42

[52] U.S. Cl. ..... 343/872; 52/281

[58] Field of Search ..... 343/872, 873; 52/281, 780

[56] References Cited

U.S. PATENT DOCUMENTS

| | | | |
|---|---|---|---|
| 2,787,812 | 3/1957 | Long | 52/780 |
| 3,624,974 | 12/1971 | Addington | 52/780 |
| 3,832,715 | 8/1974 | Afifi et al. | 343/761 |
| 4,312,158 | 1/1982 | Teli et al. | 52/39 |
| 4,342,177 | 8/1982 | Smith | 52/281 |
| 4,459,790 | 7/1984 | Vermillion | 52/780 |
| 4,710,778 | 12/1987 | Radov | 343/882 |
| 4,896,164 | 1/1990 | Burke et al. | 343/872 |
| 5,349,362 | 9/1994 | Forbes et al. | 343/720 |
| 5,375,353 | 12/1994 | Hulse | 40/217 |
| 5,625,369 | 4/1997 | Newman | 343/770 |

*Primary Examiner*—Don Wong
*Assistant Examiner*—Tan Ho
*Attorney, Agent, or Firm*—Hardaway Law Firm, P.A.

[57] ABSTRACT

An antenna enclosure comprising building elements and a support structure is disclosed. The enclosure is designed to be substantially transparent to electromagnetic waves and to have the appearance of the surrounding architecture or locale so that the antenna does not cause an obtrusive visual distraction.

13 Claims, 9 Drawing Sheets

BUILDING ELEMENTS AND SUPPORT STRUCTURE FOR ENCLOSING AN ANTENNA

BACKGROUND OF THE INVENTION

1. Field of the Invention

This invention relates, in general, to the art of antenna enclosures, and, in particular, to the art of antenna enclosures that blend in with the architecture and scenery of the location in which they are located.

2. Description of Related Art

The proliferation of satellite dishes for home use and antenna towers for cellular telephones has, according to many people, had an adverse impact on the landscapes of the areas in which these items are built. Accordingly, many locales place restrictions on the construction of satellite dishes and cellular antenna towers. Similarly, even in those places where there are no local ordinances prohibiting or restricting their use, the private owner of a location most suitable for the placement of a cellular antenna or satellite dish, e.g., the owner of the tallest building in the area, may deny placement of the cellular antenna or satellite dish at that location because it would detract from the aesthetic value of the location. Accordingly, methods by which satellite dishes, cellular antenna towers, and other types of antennas can be unobtrusively implemented have been developed.

For example, U.S. Pat. No. 4,710,778 to Radov illustrates concealing a small satellite dish in a hole in a roof of a home. A bulging dome-like canopy is used to protect the dish while allowing the dish to have some degree of movement.

U.S. Pat. No. 5,349,362 to Forbes et al. illustrates concealing an antenna in a vent pipe of a building.

Finally, U.S. Pat. No. 5,375,353 to Hulse illustrates the use of a weather resistant fabric, such as vinyl covered polyester cloth, with an outer coating of polyvinyl chloride (PVC), to cover the steel girders of various portions of an antenna tower (Hulse does not illustrate the antenna, itself).

While each of these approaches may be suitable for their intended uses, there is still room for improvement within the art.

SUMMARY OF THE INVENTION

It is an object of the invention to provide a building element and an associated support structure for enclosing an antenna.

Another object is that the building elements can be designed to be substantially self supporting.

Still another object is that the antenna enclosure can be designed to allow full 360° reception and transmission of electromagnetic waves.

These and other objects of the invention are achieved by a building element having an outer skin layer that is made from a material substantially transparent to the electromagnetic waves to be received or discharged by an antenna to be enclosed. In addition, the outer skin layer has a side that is treated to look like the surrounding architecture or locale. A cantilever structure is employed to support the building elements and secure the antenna enclosure to a foundation.

In accordance with another aspect of the invention, the building elements have inner cores that are substantially transparent to electromagnetic waves. The inner cores can be secured to each other through adhesives or physically interlocked to form a self supporting structure with the help of the outer skin layer.

Additional objects and advantages will become apparent to those skilled in the art upon examination of the following described embodiments given with reference to the various figures.

DETAILED DESCRIPTION

In accordance with this invention, different embodiments of a building element and an associated support structure for enclosing an antenna will now be described.

In assessing prior art attempts at concealing or camouflaging satellite dishes and/or cellular antennas and/or other types of antennas or the like, two deficiencies have been observed. In particular, either a specially manufactured antenna is needed and constructed that will fit into a specific confined space, e.g., Forbes, et al., or the antenna is merely covered, e.g., Hulse, still creating a somewhat obtrusive visual distraction.

However, according to the invention, individual building elements are contemplated for use in a support structure for enclosing any type of antenna without creating an obtrusive visual distraction. The antenna types include, but are not limited to, conventional off-the-shelf satellite dish arrays, cellular antennas, and/or other types of antennas. Indeed, according to the invention, even the careful observer should not be able to notice that the antenna enclosure is not what it appears to be, e.g., the top floor of a building, a penthouse, or standard rooftop screening used commonly to house HVAC systems.

Figure 1A:
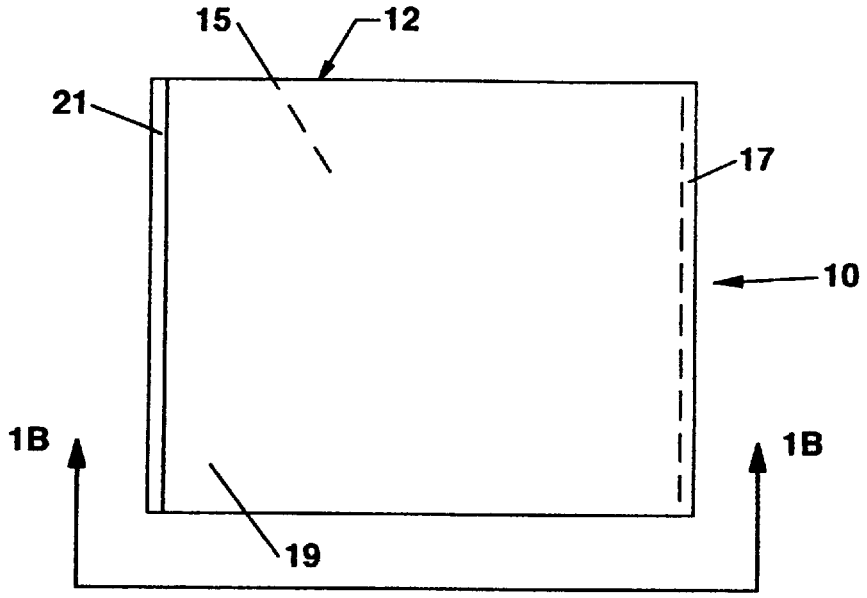
FIG. 1A is an elevation view of a first embodiment of a building element for constructing antenna enclosures according to the invention.
Figure 2A:
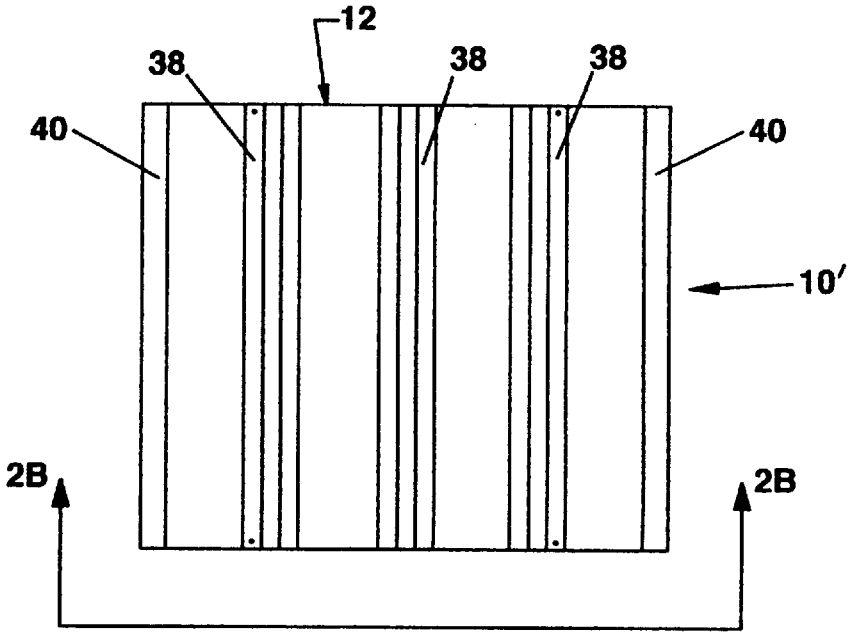
FIG. 2A is an elevation view of a second embodiment of a building element for constructing antenna enclosures according to the invention.
Figure 1B:
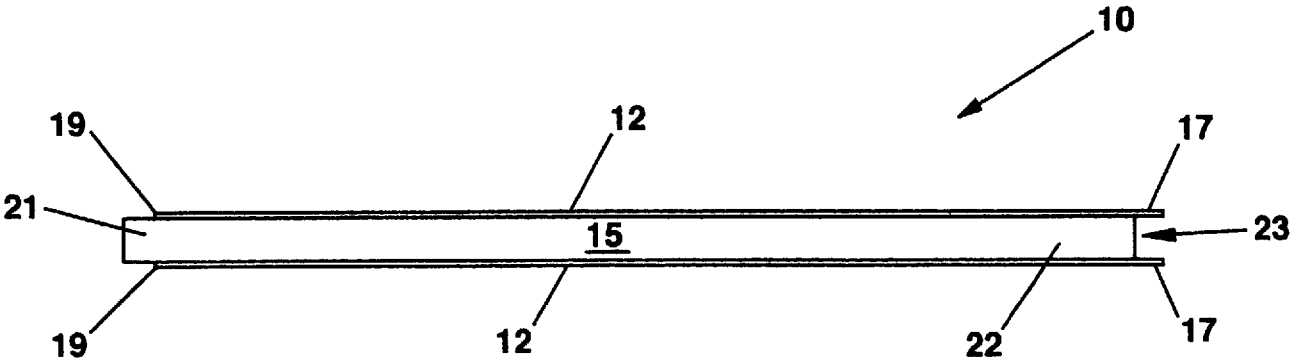
FIG. 1B is plan view of the first embodiment of a building element for constructing antenna enclosures according to the invention and taken along line 1B—1B of FIG. 1A.
Figure 2B:
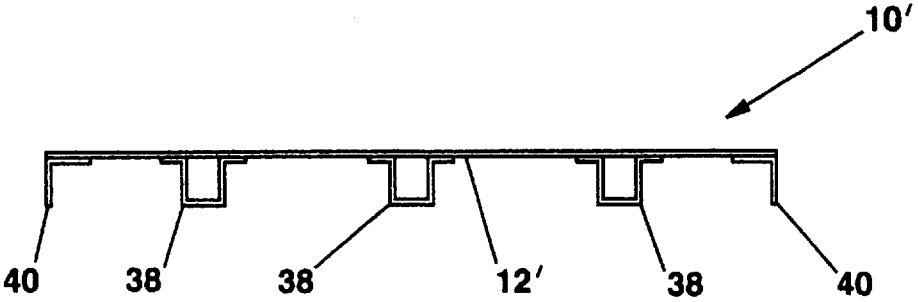
FIG. 2B is a plan view of the second embodiment of a building element for constructing antenna enclosures according to the invention and taken along line 2B—2B of FIG. 2A.
Figure 1C:
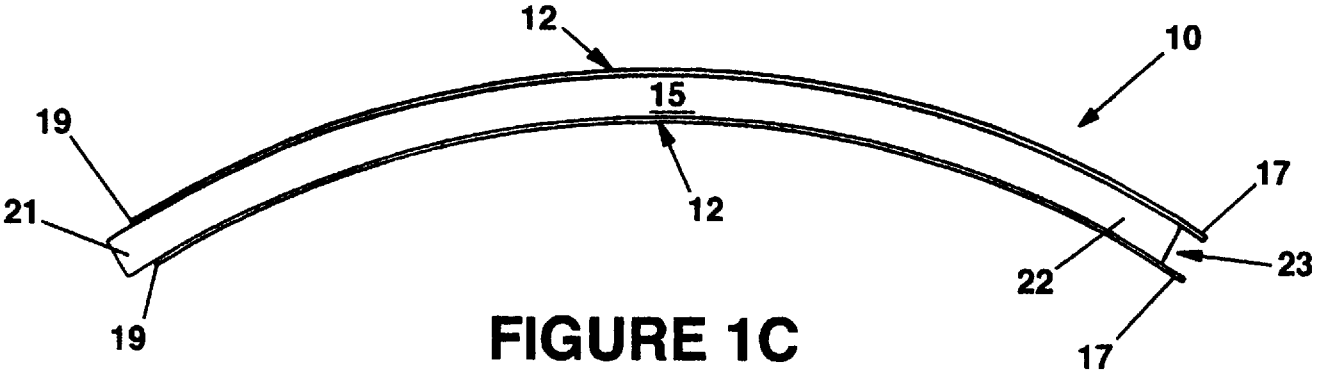
FIG. 1C is a view similar to that of FIG. 1B, but of an arcuate version of the first embodiment of a building element for constructing antenna enclosures according to the invention.
Figure 2C:
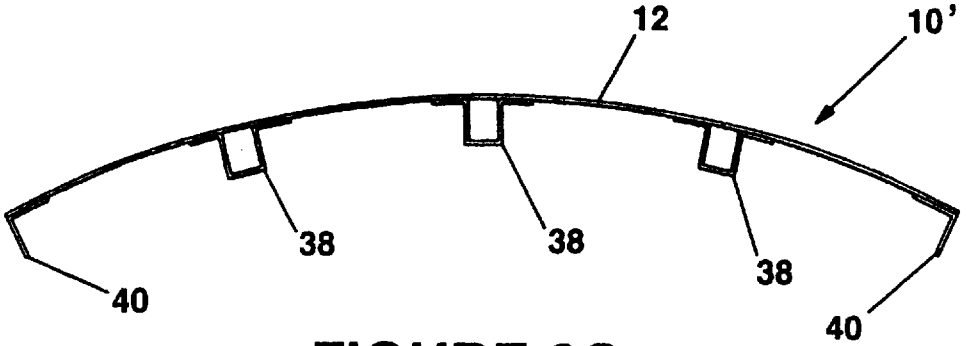
FIG. 2C is a view similar to that of FIG. 2B, but of an arcuate version of the second embodiment of a building element for constructing antenna enclosures according to the invention.

As used herein, "building element", is meant to have a generic meaning, including but not limited to either the block-like configuration of FIGS. 1A–C or the panel-like configuration of FIGS. 2A–C. The term should be thought of as comprising any building element designed and constructed as falling within the scope of the invention defined herein.

FIG. 1A is an elevation view of a first preferred embodiment of building element 10 for constructing antenna enclosures according to the invention. Block-like building element 10 will typically be rectangular and have planar surfaces. However, the shape of building element 10 depends upon the final shape of the antenna enclosure to be constructed. For example, it is possible that building elements 10 may be arcuate (FIG. 1C) to allow for the construction of circular or round antenna enclosures, such as those having the appearances of grain silos or water towers, as described below.

The first embodiment of building element 10 according to the invention typically comprises three components, namely: first and second outer skin layers 12 and inner core 15. Inner core 15 provides the primary structural rigidity and strength to building element 10 and will typically be made from a closed cell foam such as polystyrene, although other lightweight materials may also be used so long as the material selected is structurally sound and substantially transparent to the electromagnetic waves to be received or discharged by the antenna to be enclosed. First and second outer skin layers 12 are typically made from conventional ABS (acrylonitrile butadiene styrene) made by a variety of manufacturers. One well known source of ABS is Spartech Plastics. Alternative materials that can be used for outer skin layers 12 include Duraform Architectural Telecommunications Panels made by Vacuform Industries, Inc., of Columbus, Ohio; conventional vinyl laminated polyester made by numerous manufacturers; or, least preferably and in non-signal receiving or discharging areas, RF-friendly fiberglass. First and second outer skin layers 12 are more for protecting the closed cell foam from the outdoor elements, and treatment with decorative material, as will be described below. Structural strength is not a primary concern of skin layers 12. Therefore, the primary concerns in selecting the material for outer skin layers 12 are: substantial transparency to electromagnetic waves and amenability for treatment such as painting, thermo-forming, or epoxying to make building elements 10 look like either the surrounding architecture or whatever the antenna enclosure is to have the appearance of. ABS has been found to excel in both roles and is therefore highly preferred.

For example, if the final antenna enclosure is going to be placed on the roof of a brick or other type of building, outer skin layer 12 can be treated to have the appearance of bricks and mortar or whatever the building is constructed of so that the antenna enclosure looks like the top floor of the building. Even air conditioning ducts, vents, and louvres may be simulated so that the antenna enclosure can be made to look like a structure enclosing roof-top utility equipment. Similarly, in rural areas, if a cellular antenna is going to be placed in an enclosure that appears to be a grain silo, after the grain silo is constructed using a plurality of preferably arcuate building elements 10, the outer skin layer 12 can be treated to have the appearance of the materials typically used to make grain silos. It is also possible to enclose cellular antennas on water towers. The variations are endless.

As mentioned above, building elements 10 are treated to look like either the surrounding architecture or whatever the enclosure is to have the appearance of. This treatment can be done in a variety of ways. The simplest method of generating a desired appearance involves merely painting outer skin layer 12 so that it has the desired appearance. For example, brick and beige colored paints can be used to simulate brick and mortar and silver paint can be used to simulate the shiny metal sometimes used to construct a grain silo. When painting is used, care must be taken that the material out of which outer skin layer 12 is made does not encourage the paint to peel off. Another method of generating the desired appearance comprises thermo-forming outer skin layer 12 with the desired appearance. For example, if a brick and mortar appearance is desired, a hot grid may be placed onto outer skin layer 12 so as to form indented rectangular outlines. The outlines themselves can then be painted the color of mortar while the areas that they bound can be painted the color of bricks. This will provide for a more three-dimensional appearance of the enclosure surface, thereby making it look even more like what it is supposed to. Similarly, a combination of thermo-forming and painting could be used to make outer skin layers 12 have the appearance of air conditioning ducts, vents, and even louvres. Finally, epoxying may be used to generate the desired appearance. This involves building up areas of outer skin layer 12 with epoxy to generate a particular relief consistent with the desired appearance. For example, bricks or stucco can be simulated. The dried epoxy is then painted the desired colors. As can be seen, there are many different ways of implementing the invention.

When selecting the actual materials for use in making a building element 10, the primary concern is always that the material be transparent to the electromagnetic waves to be received or discharged by the antenna to be enclosed, i.e., allows them to pass through the material with only minimal interference and signal degradation.

Figure 3A:
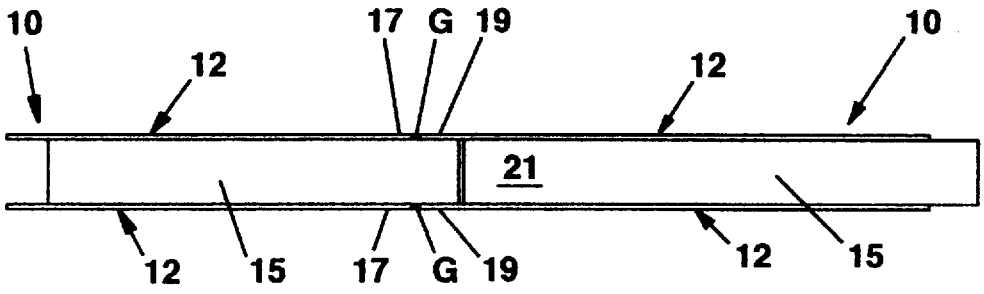
FIG. 3A is a plan view showing the preferred method by which multiple building elements according to the first embodiment of the invention can be interlocked.

Building elements 10 according to the first embodiment of the invention are constructed such that they can interlock with each other when constructing an antenna enclosure. However, this ability to interlock is not critical to the success of the invention. One way of achieving the interlock of building elements 10 is by offsetting first and second outer skin layers 12 from inner core 15. As shown in FIGS. 1B, 1C, this offsetting results in a front portion 21 of inner core 15 extending past the front edges 19 of first and second outer skin layers 12 and a rear portion 22 of inner core 15 extending inward from the rear edges 17 of first and second outer skin layers 12, thereby forming a 'u' shaped area 23. As shown in FIG. 3A, two building elements 10 are interlocked by placing front portion 21 of the first building element 10 in the 'u' shaped area 23 of the second building element 10. A slight friction fit between rear edges 17 of first and second outer skin layers 12 and front portion 21 of inner core 15 is useful to keep the building elements 10 in contact with one another. Furthermore, gap G of approximately ⅛" is provided between rear edges 17 of one building element 10 and front edges 19 of second building element 10 to account for thermal expansion of the ABS or other material used to make skin layers 12. On the other hand, the inner cores 15 of both building elements 10 may be abutted against each other because their material of construction is typically not subject to much thermal variation.

Figure 3B:
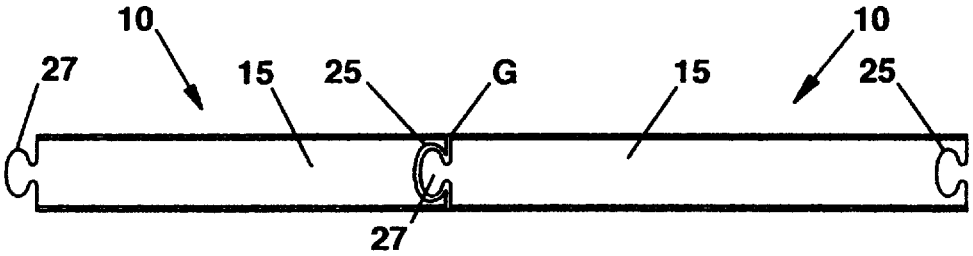
FIG. 3B is a plan view showing an alternative method by which multiple building elements according to the first embodiment of the invention can be interlocked.

An alternative method by which two of the first embodiment of the building elements 10 according to the invention can be interlocked is shown in FIG. 3B. In FIG. 3B, front portion 21 and rear portion 22 of core 15, itself, are formed into groove 25 and tongue 27, respectively. Accordingly, tongue 27 of one building element 10 is placed into groove 25 of the other building element 10. In this embodiment, first and second outer skin layers only need span the length of core 15 and are constructed to provide for the gap G in the manner as described above with respect to FIG. 3A. Finally, as shown in FIG. 3B, there can be a tight fit between tongue 27 and groove 25 since as described above with respect to FIG. 3A there is little thermal expansion of the materials out of which inner cores 15 are constructed.

Figure 3C:
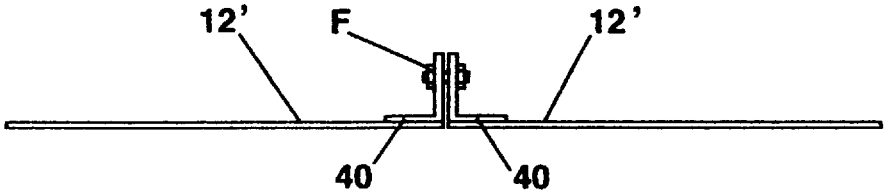
FIG. 3C is a plan view showing the preferred method by which multiple building elements according to the second embodiment of the invention can be interlocked.
Figure 3D:
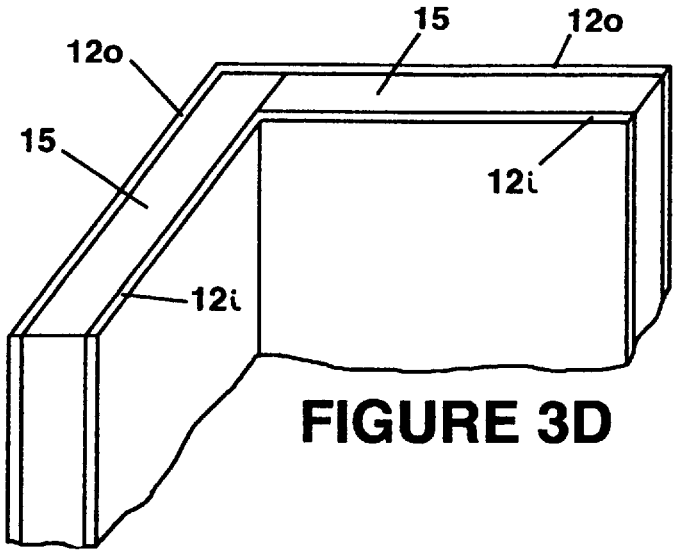
FIG. 3D is a perspective view showing a self supporting corner building element for an antenna enclosure.
Figure 4A:
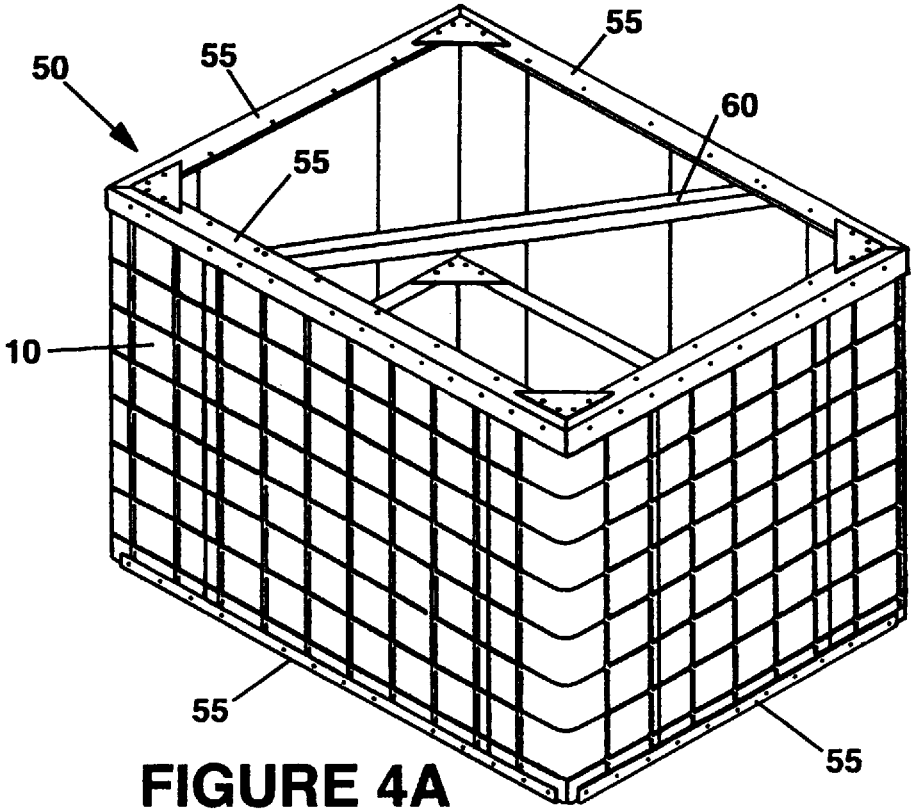
FIG. 4A is a perspective view of an antenna enclosure formed from self-supporting, interlocking building elements according to the first embodiment of the invention.
Figure 3E:
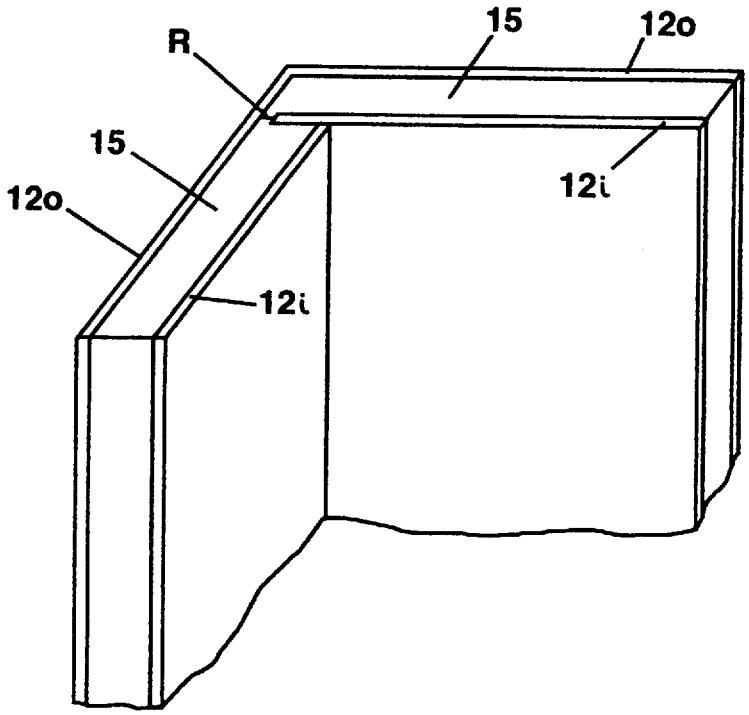
FIG. 3E is a perspective view showing an alternative self supporting corner building element for an antenna enclosure.

Because inner core 15 provides structural rigidity and allows building elements 10 to be interlocked together, an entire antenna enclosure can be constructed using primarily building elements 10 with little additional support structure. FIG. 3D shows two building elements 10 joined together to form a corner of an antenna enclosure. Inner cores 15 meet at a right angle to form the corner. Any appropriate adhesive means can be used to secure the two cores together. Outer skin layer 12*o* is formed to wrap around the corner providing additional stability. Similarly, inner skin layer 12*i* can be used to wrap around the inside of the corner for maximum stability. Moreover, since the outer skin layers can be formed to virtually any desired configuration, a custom building element can be constructed to conform to atypical geometric requirements. FIG. 3E shows a second embodiment of the corner where each inner core 15 has its own inner skin layer 12*i*. In this example, inner core 15 of one building element is secured to inner layer 12*i* of a second building element. Along a narrow region R, the two inner cores 15 are secured to one another. Both building elements share a common outer skin layer 12*o*. FIG. 4A shows an antenna enclosure 50 made substantially from interlocking building elements 10. Angle irons 55 and cross beam 60 are the only additional structure used to support the enclosure. Cross beam 60 may also be used as a support for hanging the antenna. While this antenna enclosure will not have the same structural integrity as enclosures with more substantive infrastructures, it has the advantage that there is less structure to interfere with the electromagnetic waves. The antenna enjoys full 360° transmission and reception capability even through the corners of the enclosure.

Electromagnetic waves must be able to pass through building elements 10 without much deterioration in signal. However, when the above materials are used, i.e., closed cell foam and ABS, due to their highly transmissive nature with respect to electromagnetic radiation, the dimensions of building element 10 are not that important. Therefore, while it is preferable to have the foam core and each of the outer ABS skin layers about 2" and ⅛" thick, respectively (FIG. 1B), the thickness used depends primarily on two factors: 1) how much additional structure is employed to support the antenna enclosure, and 2) the wavelength of the signal to be transmitted or received.

A second embodiment of a building element according to the invention is shown in FIGS. 2A, 2B, and 2C. In FIGS. 2A and 2B, the rectangular, planar version of building element 10' is shown. In FIG. 2C, the arcuate version of building element 10' is shown. Both versions of building element 10' are formed by taking outer skin layer 12', made from a material substantially transparent to the electromagnetic waves to be received or discharged by the antenna to be enclosed, preferably ABS, and integrally attaching structural support members 38 along its width at various intervals. Due to its relatively thinner configuration, the second embodiment of building element 10' is sometimes referred to as a "panel" (cf. the first embodiment of building element 10 sometimes referred to as a "block"). Support members 38 are provided to supply the structural integrity needed to resist wind shears due to the absence of core 15. While it is preferred that structural members 38, which may also be known as hat channels or channel members due to their inverted hat-channel-like cross-section, be integral with skin 12', it is also possible for structural members 38 to be separate members and implemented as will be described below. Structural members 38 are associated with the side of skin 12' opposite the side to be treated to look like the surrounding architecture or locale. Finally, as shown in FIG. 3C, end brackets 40 having fastener holes therethrough are provided to join together two building elements 10' end-to-end by use of fasteners F.

Figure 4:
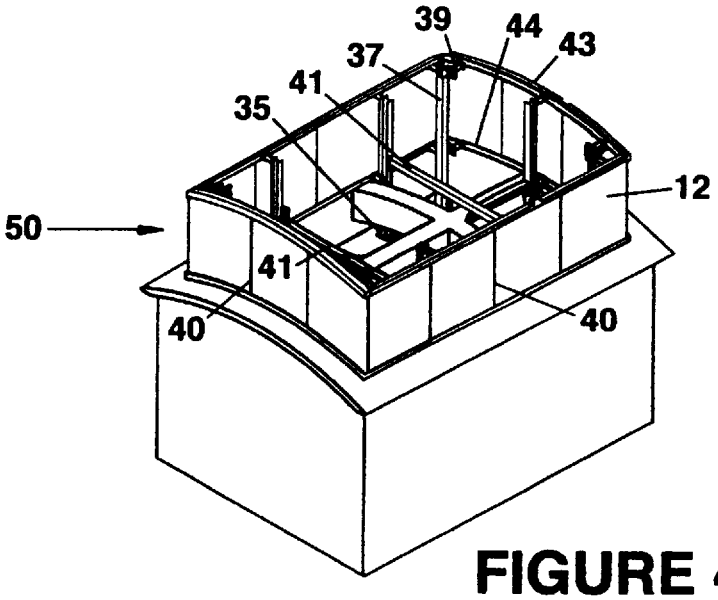
FIG. 4 is a perspective view of an antenna enclosure showing a cantilever support structure and made using the first embodiment of the building elements.

FIG. 4 illustrates an example of an antenna enclosure 50 made from building elements 10 and a cantilever support structure. This enclosure can as easily have been constructed using building elements 10'. Indeed, in discussing enclosure 50, when differences come up that would result from the use of building elements 10' rather than 10, the nature of the difference will be discussed. Otherwise, the steps in building enclosure 50 out of building elements 10' are the same as when building it out of elements 10.

Figure 10:
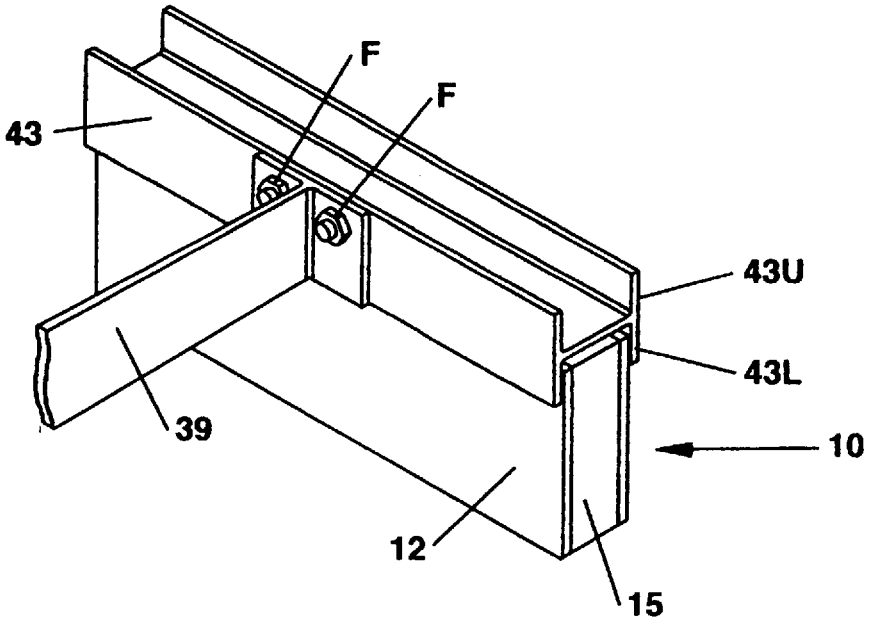
FIGS. 10 and 11 are perspective views showing the horizontal tracks, the cantilever supports, and the support beam holding a building element.
Figure 5:
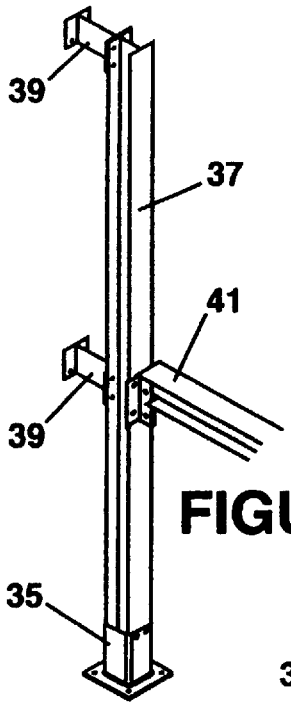
FIG. 5 is a perspective view of a side support beam showing cantilever supports, a stability brace beam, and a base mount.
Figure 6:
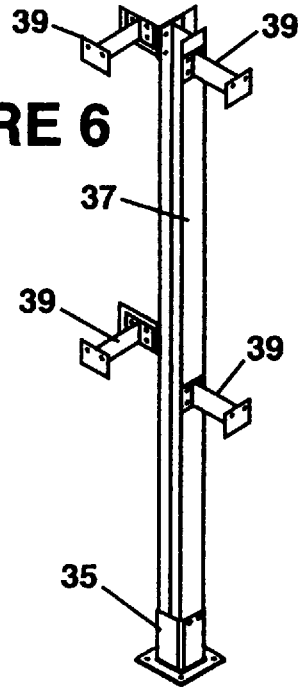
FIG. 6 is a perspective view of a corner support beam showing cantilever supports, and a base mount.
Figure 7:
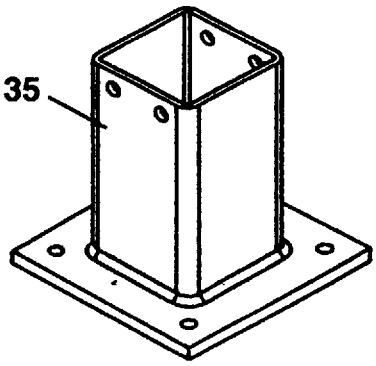
FIG. 7 is a perspective view of the base mount.
Figure 8:
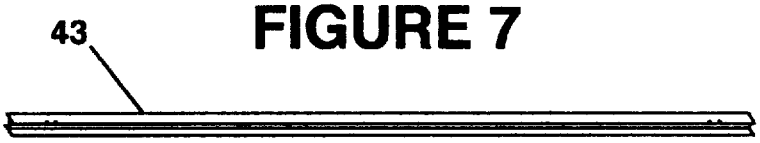
FIG. 8 is a perspective view of a horizontal track for holding a building element.
Figure 9:
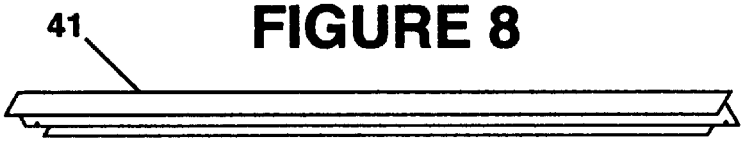
FIG. 9 is a perspective view of the stability brace beam.
Figure 11:
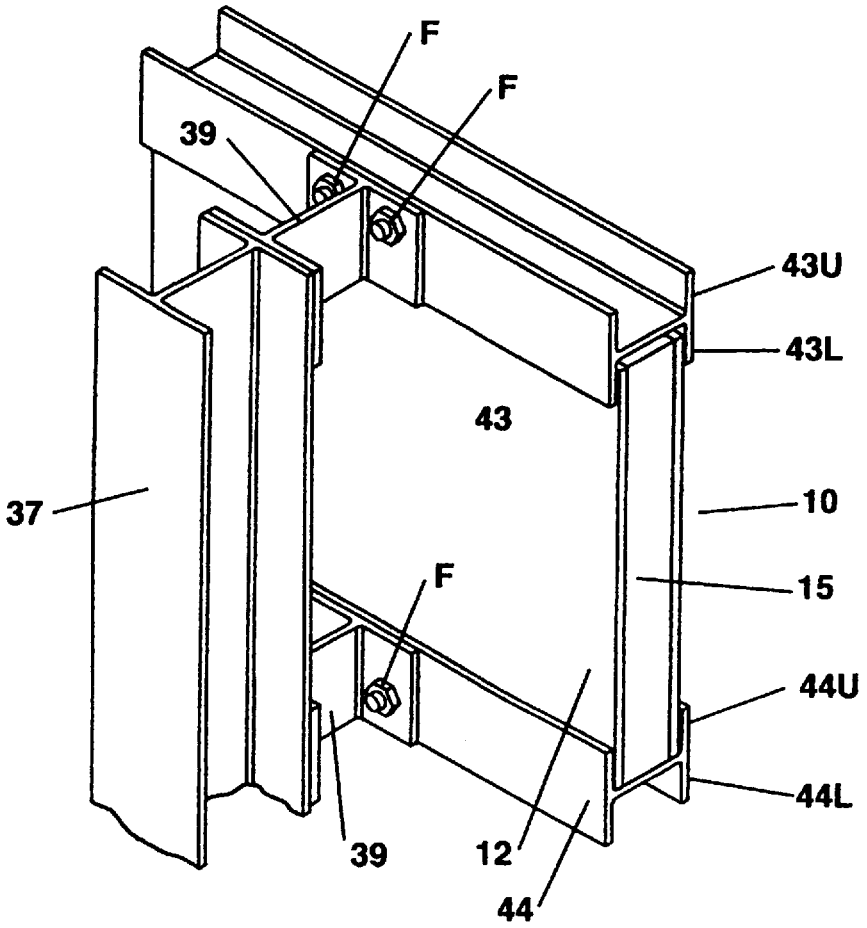

Exemplary antenna enclosure 50 is constructed generally as follows, although it is possible to vary the order of the steps somewhat:

1) Base mounts 35, shown in FIG. 7, are fastened to the surface on which antenna enclosure 50 is to be built. This surface may comprise, for example, the roof of a building or a concrete slab at ground level;
2) Main vertical support i-beams 37 are attached to base mounts 35. FIGS. 5 and 6 show side and corner vertical supports 37 and their attachment to base mounts 35;
3) Cantilever supports 39 are attached to vertical supports 37 (see FIGS. 4, 5, and 6) at strategic locations based on the size of building elements 10 and the overall shape of antenna enclosure 50.
4) Lower horizontal tracks 44 are attached to cantilever supports 39 by use of fasteners F (see FIGS. 4 and 11), so as to construct a track conforming to the desired antenna enclosure shape, which in this example is rectangular, but may be triangular or any other shape;
5) Brace beams 41 are attached to opposing main vertical supports 37 to provide horizontal stability for the structure. In alternative embodiments, brace beams 41 could be attached to a building foundation or any other stabilizing source;
6) Upper horizontal tracks 43 are then secured to cantilever supports 39 by fasteners F. Building elements 10 are then stood upright or lengthwise, depending upon the desired height for the antenna enclosure, within the rectangular tracks defined by the upper half of lower horizontal track 44*u* (see FIG. 11) and the lower half of upper horizontal track 43*l*. If building elements 10' are used, structural members 38 should be of proper width to fit into the horizontal tracks or L-channel spacers (not shown) could be used to take up any extra space. Lines 40 (see FIG. 4) represent seams between adjacent building elements 10. Building elements 10 can also be interlocked if desired. FIGS. 10 and 11 illustrate the reception of building element 10 between the horizontal tracks. Horizontal tracks 43 and 44 are preferably I or H-shaped to allow for reception of a building element 10 in one channel and the use of fasteners F in the other channel as shown in FIGS. 10 and 11.

Some of the various structural members of FIG. 4, namely: main vertical supports 37, upper and lower horizontal tracks 43 and 44, cantilever supports 39, and brace beams 41, may be made from a material substantially transparent to electromagnetic waves. Typically, that material will be fiberglass due to its light weight and transparency to electromagnetic waves. However, the choice of material used for the structural members will depend primarily on the type of antenna to be enclosed and the size of transparent window required. For example, if the antenna is aimed out one side of the enclosure, it is not necessary to use an expensive material such as fiberglass or ABS for the entire support structure. Base mounts 35 may be made from fiberglass or even steel since there is no chance that incoming or outgoing electromagnetic waves will pass through base mounts 35.

While the present invention has been illustrated and described in detail in the drawings and foregoing description, it is understood that only a preferred embodiment has been shown and described. All changes and modifications that come within the spirit of the invention as defined by the following appended claims are desired to be protected.

That which is claimed:

1. An antenna enclosure comprising:

a building element having an outer skin layer, said outer skin layer being made from a material substantially transparent to electromagnetic waves that are received or discharged by an antenna to be enclosed;

said outer skin layer having a side adapted to look like the surrounding architecture or locale;

means for receiving said building element;

cantilever means for supporting said receiving means; and means for supporting said cantilever means, said support means securing said antenna enclosure to a foundation.

2. The antenna enclosure of claim 1, wherein said outer skin comprises first and second outer skin layers;

said building element further comprises an inner core, said inner core formed in between said first and second outer skin layers; and wherein said first and second outer skin layers and said inner core are made from a material that is substantially transparent to electromagnetic waves that are received or discharged by an antenna to be enclosed.

3. The antenna enclosure of claim 1, wherein said support means comprises:

a base mount affixed to said foundation;

an i-beam rising vertically from said base mount; and a brace connecting said i-beam to a support member whereby pivotal movement of said i-beam relative to said foundation is constrained.

4. The antenna enclosure of claim 1, wherein said receiving means comprises a track member whereby said track member receives said building element along an edge thereof.

5. The antenna enclosure of claim 1, wherein said cantilever means comprises an i-beam, said i-beam extending outward from said enclosure in cantilever fashion.

6. An antenna enclosure comprising:

a building element having an outer skin layer, said outer skin layer being made from a material substantially transparent to electromagnetic waves that are received or discharged by an antenna to be enclosed;

said outer skin layer having a side adapted to look like the surrounding architecture or locale;

a track member, said track member receiving said building element within an edge thereof;

a first i-beam supporting said track member, said first i-beam extending outward from said enclosure in cantilever fashion;

said first i-beam connected to a second i-beam rising vertically from a base mount;

said base mount affixed to a foundation; and a brace connecting said second i-beam to a support member whereby pivotal movement of said second i-beam relative to said foundation is constrained.

7. The antenna enclosure of claim 6, wherein said outer skin comprises first and second outer skin layers;

said building element further comprises an inner core, said inner core formed in between said first and second outer skin layers; and wherein said first and second outer skin layers and said inner core are made from a material that is substantially transparent to electromagnetic waves that are received or discharged by an antenna to be enclosed.

8. An antenna enclosure comprising:

a building element, said building element comprising first and second outer skin layers and an inner core formed in between said outer skin layers;

wherein said first and second outer skin layers and said inner core are made from a material that is substantially transparent to electromagnetic waves that are received or discharged by an antenna to be enclosed;

said first and second outer layers are offset from said inner core such that a front portion of said inner core protrudes out beyond front edges of said first and second outer layers and a rear portion of said inner core is inward of rear edges of said first and second outer layers to form a unshaped channel;

whereby one building element is capable of being interlocked to another by placing said front portion of said inner core of a first building element into said unshaped channel of a second building element;

an outside surface of one of said first and second outer skin layers having a side adapted to look like the surrounding architecture or locale;

means for receiving said building element;

cantilever means for supporting said receiving means; and means for supporting said cantilever means, said support means securing said antenna enclosure to a foundation.

9. The antenna enclosure of claim 8, wherein:

said receiving means comprises a track member, said track member receiving said building element along an edge thereof;

said cantilever means comprises a first i-beam extending outward from said enclosure in cantilever fashion;

said support means comprises a second i-beam rising vertically from a base mount;

said base mount affixed to a foundation; and a brace connecting said second i-beam to a support member whereby pivotal movement of said second i-beam relative to said foundation is constrained.

10. An antenna enclosure comprising:

a building element, said building element comprising first and second outer skin layers and an inner core formed in between said outer skin layers;

wherein said first and second outer skin layers and said inner core are made from a material that is substantially transparent to electromagnetic waves that are received or discharged by an antenna to be enclosed;

an outside surface of one of said first and second outer skin layers adapted to look like the surrounding architecture or locale;

whereby the building element is capable of being joined to another building element to substantially support said antenna enclosure by securing said inner core of a first building element to said inner core of a second building element and said first and second building elements share a common said outer skin layer; and whereby said antenna enclosure provides 360° transmission and reception capability for said antenna to be enclosed.

11. The antenna enclosure of claim 10, further comprising:

support means for adding structural rigidity to said antenna enclosure; and means for securing said antenna enclosure to a foundation.

12. An antenna enclosure comprising:

a wall and a corner, said wall and said corner comprised of a plurality of building elements;

said building elements comprising first and second outer skin layers and an inner core formed in between said outer skin layers;

wherein said first and second outer skin layers and said inner core are made from a material that is substantially transparent to electromagnetic waves that are received or discharged by an antenna to be enclosed;

an outside surface of one of said first and second outer skin layers adapted to look like the surrounding architecture or locale;

said corner comprising one building element joined to another by securing said inner core of a first building element to said inner core of a second building element and said first and second building elements share a common said outer skin layer; and said wall comprising one building element interlocked to another, said wall building elements having said first and second outer layers offset from said inner core such that a front portion of said inner core protrudes out beyond front edges of said first and second outer layers and a rear portion of said inner core is inward of rear edges of said first and second outer layers to form a u-shaped channel;

whereby one wall building element may be interlocked to another by placing said front portion of said inner core of a first building element into said u-shaped channel of a second building element; and whereby said antenna enclosure is substantially supported by said wall and said corner and provides 360° transmission and reception capability for said antenna to be enclosed.

13. An antenna enclosure comprising:

a building element, said building element comprising first and second outer skin layers and an inner core formed in between said outer skin layers;

said first outer skin layer having a horizontal edge;

said second outer skin layer having a horizontal edge;

said building element being shaped such that a cross-section of said element is a geometric shape wherein said length of said horizontal edge of said second outer skin layer is less than said length of said horizontal edge of said first outer skin layer;

wherein said first and second outer skin layers and said inner core are made from a material that is substantially transparent to electromagnetic waves that are received or discharged by an antenna to be enclosed; and an outside surface of one of said first and second outer skin layers adapted to look like the surrounding architecture or locale.

* * * * *